US005438164A

United States Patent [19]

Green

[11] Patent Number: 5,438,164

[45] Date of Patent: Aug. 1, 1995

[54] INSULATED ELECTRICAL CONDUCTOR AND METHOD

[76] Inventor: Edward A. Green, 4419 State Rte. 82, Mantua, Ohio 44255

[21] Appl. No.: 187,013

[22] Filed: Jan. 27, 1994

[51] Int. Cl.[6] ..... H01B 7/28

[52] U.S. Cl. ..... 174/120 R; 174/121 R; 174/122 G; 174/122 C; 427/461

[58] Field of Search ..... 174/120 R, 121 R, 121 A, 174/122 R, 122 G, 122 C; 427/461

[56] References Cited

U.S. PATENT DOCUMENTS

| | | | |
|---|---|---|---|
| 2,234,560 | 3/1941 | Keyes | 174/121 R |
| 3,030,257 | 4/1962 | Whearley et al. | 156/52 |
| 3,033,917 | 5/1962 | Heckel et al. | 174/121 R |
| 4,072,129 | 2/1978 | Bright et al. | 118/629 |
| 4,131,690 | 12/1978 | Jukes et al. | 427/461 |
| 4,402,789 | 9/1983 | Vexler | 162/106 |
| 4,595,793 | 6/1986 | Arroyo et al. | 174/121 A |
| 4,711,833 | 12/1987 | McAneney et al. | 430/131 |
| 4,761,520 | 8/1988 | Wade, Jr. et al. | 174/121 R |
| 5,075,514 | 12/1991 | Hund | 174/117 F |
| 5,232,746 | 8/1993 | Bladel et al. | 427/470 |

*Primary Examiner*—Morris H. Nimmo
*Attorney, Agent, or Firm*—Albert E. Chrow

[57] ABSTRACT

A high temperature resistant insulated electrical conductor (100) is provided in which a electrostatically deposited layer (6) of fluorocarbon material is disposed about a fiberglass insulation layer (4) encompassing a stranded or solid electrical conductor (2). Layer (6) is surrounded by a layer (8) of fiberglass insulation which in turn is preferably encompassed by a braided layer (10) of fiberglass insulation which is preferably coated with a layer (2) of protective high service temperature material. Layer (6) is preferably sintered to provide a fused homogenous construction as is layer (12) when required.

20 Claims, 1 Drawing Sheet

INSULATED ELECTRICAL CONDUCTOR AND METHOD

INTRODUCTION

This invention relates generally to an insulated electrical conductor and more particularly to an electrical conductor insulated with both fiberglass and electrostatically deposited fluorocarbon material to provide high temperature resistance.

BACKGROUND OF THE INVENTION

Although fiberglass and fluorocarbon material, such as polytetrafluoroethylene sold under the trademark TEFLON by the Dupont Company, have respectively been used as high temperature resistant insulation about electrical conductors for many years, no one heretofore had thought to provide the combination of fiberglass and electrostatically deposited fluorocarbon material as a high temperature resistant insulation about an electrical conductor.

Although fiberglass insulation is characteristically applied by spiraling or by braiding fiberglass filaments or strands about the conductor or a combination of the two, fluorocarbon materials have not heretofore been known to have been applied to an electrical conductor (wire) by electrostatic deposition let alone onto fiberglass encompassing the conductor.

The method by which fluorocarbon materials (polymers) have heretofore been applied to insulate an electrical conductor (wire) have been wrought with problems.

The fluorocarbon material polytetrafluoroethylene (PTFE) for example has excellent high temperature resistance (500 ° F.) but must be applied to electrical conductor by ram extrusion or by wrapping skived PTFE tape about the conductor. One of the problems with ram extrusion is that a slug or circular billet of PTFE being ram extruded through an orifice into a tubular configuration is generally made from a mixture of PTFE powder and solvents and the coated conductor (wire) must then be heated (sintered) to drive off solvent volatiles resulting in a high probability of voids or pinholes in the PTFE insulation. Another problem associated with ram extrusion is that it is not a continuous process so that the length of conductor (wire) being coated is limited to the size of the PTFE slug being ram extruded.

PTFE tape is skived from ram extruded cylinders and thus may also contain voids and pinholes arising from the ram extrusion process as well as being difficult to fold about small diameter conductors. As in the case of ram extruded PTFE, the tape length is also limited due to its having been skived from a cylinder of fixed diameter and length.

Although fluorocarbon materials that are melt extruded (thermoplastic) such as ethylene fluorinated ethylene propylene (ETFE) or fluorinated ethylene propylene (FEP) do not have the problems of ram extrusion heretofore described for PTFE, they are characterized by having lower temperature resistance than PTFE. For example, the temperature resistance of FEP is 400° F. rather than the 500° F. associated with PTFE.

As described in U.S. Pat. No. 4,711,833, it is known to deposit powdered polymers (including FEP and PTFE) electrostatically onto a collapsible mandrel in a process for making a seamless (endless) belt.

It has not been known heretofore to electrostatically deposit a fluorocarbon layer onto a fiberglass layer that encompasses an elongate electrical conductor (wire).

The present invention overcomes the processing limitations of PTFE as well as accommodates other fluorocarbon materials that can be rendered into a powder in preparation for electrostatic deposition without the need for solvents or the length and porosity problems associated with both ram extruded billets and skived tape.

SUMMARY OF THE INVENTION

Accordingly, it is an object of this invention to provide a high temperature resistant insulated conductor.

It is another object of this invention to provide a insulated electrical conductor that uses a combination of fiberglass and electrostatically deposited fluorocarbon material to provide high temperature resistance.

It is still another object of this invention to provide a method for making a high temperature resistant insulated electrical conductor involving electrostatically depositing a fluorocarbon material onto a fiberglass layer encompassing the conductor.

DESCRIPTION OF SOME PREFERRED EMBODIMENTS

Figure 1:
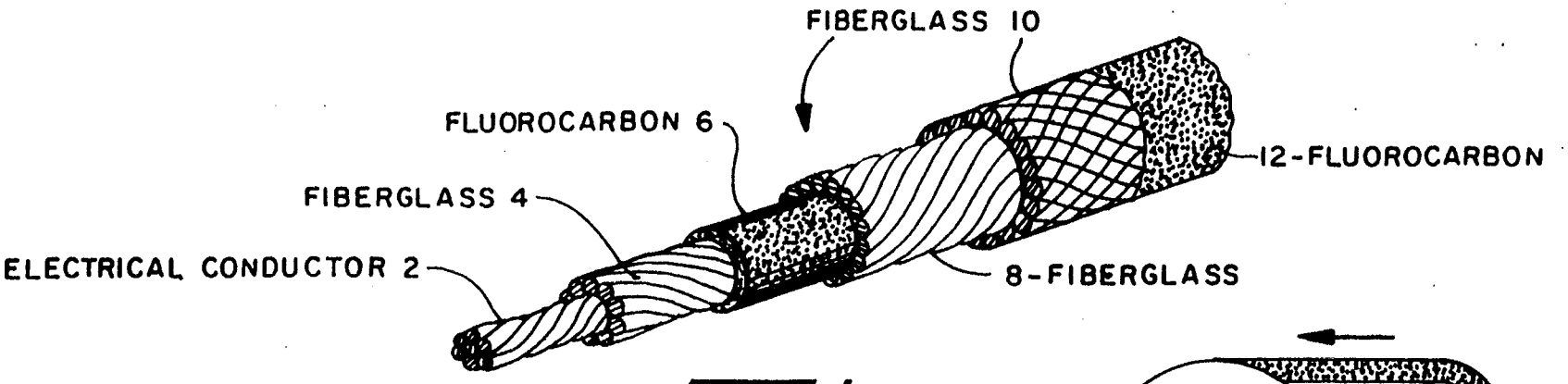
FIG. 1 is a perspective view of an embodiment of the Insulated Electrical Conductor of the invention referenced by numeral 100.

Although shown as a stranded electrical conductor referenced by numeral 2 in FIG. 1, conductor 2 may also be a solid conductor where such is desired. Conductor 2 is made from any materials or combination of materials suitable for providing the electrical characteristics desired for the insulated electrical conductor of the invention such as, for example, suitable copper alloys well known to those skilled in the art of electrical current transmission.

Conductor 2 is encompassed by a layer of fiberglass insulation referenced by numeral 4. Although layer 4 may be disposed in any suitable manner about conductor 2, it is preferably disposed by spirally wrapping strands or filaments of fiberglass thereabout and more preferably contiguously thereabout.

A layer, 6 of fluorocarbon material is disposed about layer 4 of fiberglass insulation and preferably contiguously thereabout. Layer 6 has been electrostatically deposited onto the outer surface of layer 4 and sintered to fuse it into a homogeneous solid layer as hereinafter described with respect to FIG. 2.

The fluorocarbon material is preferably polytetrafluoroethylene (PTFE) having a service temperature of about 500 ° F. but may be other fluorine bearing materials found suitable for high temperature electrical insulation applications such as fluoroethylene propylene (FEP) having a service temperature of about 400 ° F. or ethylenated polytetrafluoroethylene (ETFE) all of which are well known to those skilled in the art of fluorinated materials suitable for high temperature electrical conductor insulation.

Layer 6 of fluorocarbon material is encompassed by a layer 8 of fiberglass insulation. Like layer 4, layer 8 is preferably formed by spirally wrapping fiberglass strands or filaments about layer 6 but may be disposed by other methods such as by braiding or folding sheets of fiberglass about the conductor and the like. In the case of spirally wound fiberglass filaments or strands, they are preferably spiraled in an opposite direction to the direction of spiral winding for layer 4 to minimize any torque imparted by the spiraling operation.

Although other embodiments of the present invention may end with layer 8 as the outer layer of fiberglass insulation that may or may not be encompassed with a coating of protective high temperature material such as a suitable fluorcarbon material hereinbefore described that is disposed about layer 8 by electrostatic deposition, extrusion, emulsion coating or other suitable coating method.

Preferably however, a braided layer 10 of fiberglass filaments or strands is braided about layer 8 to provide greater integrity to the end product and also, like layer 8, to compress layer 6 of fluorocarbon material inwardly and thus aid in creating a unified layer of fluorocarbon during the sintering process.

Like an embodiment of the invention having layer 8 as its outer layer of fiberglass insulation, layer 10 of braided fiberglass filaments or strands is preferably coated with a layer 12 of protective high temperature material such as a suitable fluorocarbon material that may be disposed onto layer 10 by any suitable method such as by extrusion or emulsion coating or by electrostatic deposition followed by sintering to form a fused coating about layer 10.

Figure 2:
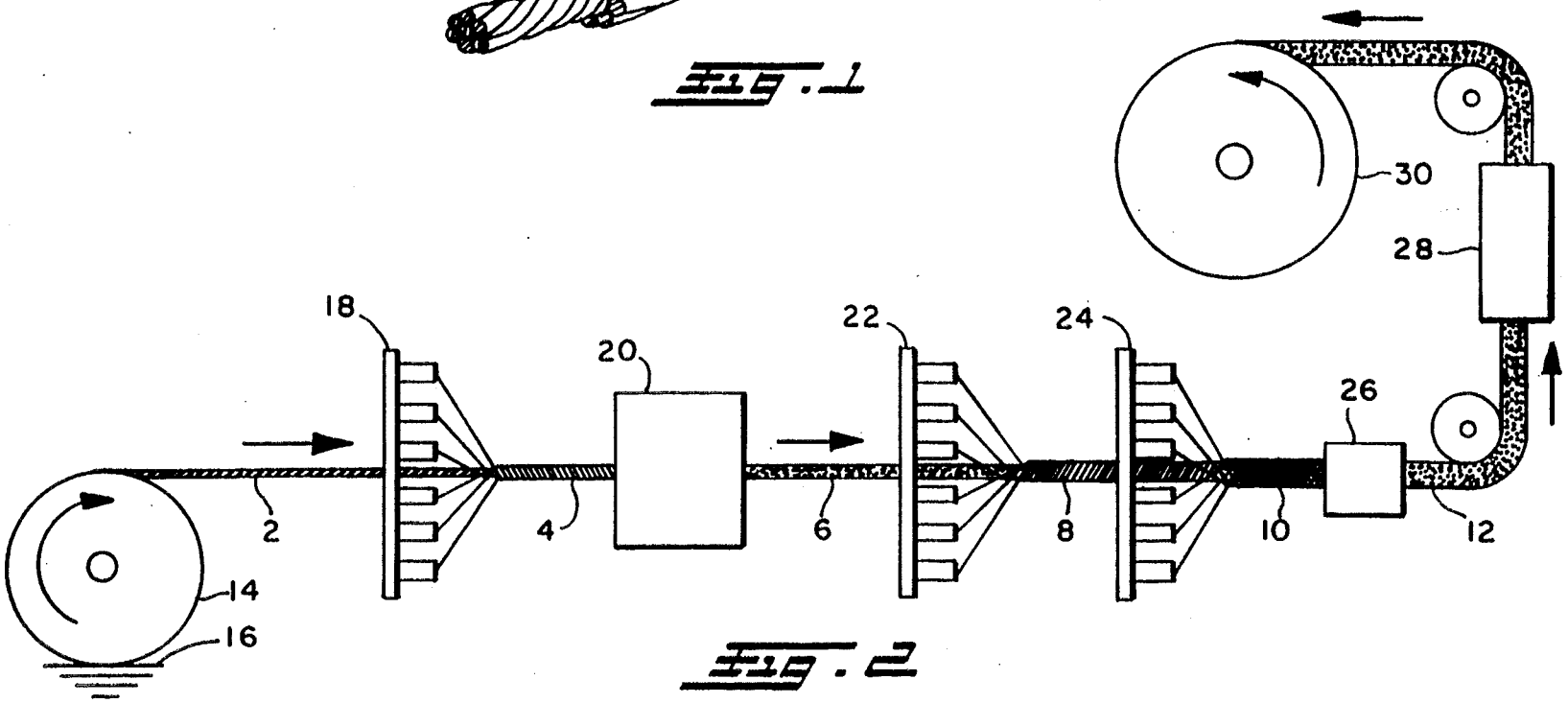
FIG. 2 is a block-schematic diagram of one method for making the insulated conductor of FIG. 1.

A preferred method by which to make insulated conductor 100 is shown in FIG. 2 in which conductor 2 is being pulled in the direction of the arrows from reel 14 by rotating reel 30. Conductor 2 is suitably grounded such as referenced by numeral 16 in preparation for the electrostatic deposition step referenced by numeral 20 hereinafter described. Layer 4 of fiberglass filaments or strands are served or spirally wound about conductor 2 under tension by a suitable spiral wrapping or serving machine referenced by numeral 18. The product of machine 18 then passes through an electrostatic deposition region generally referenced by numeral 30 in which fluorocarbon material (powdered) is electrostatically deposited onto layer 4.

The specific manner by which fluorocarbon material is electrostatically deposited onto layer 4 is not a limiting factor of the present invention and may be accomplished in a variety of ways of which two examples are described in U.S. Pat. Nos. 4,072,129 and 4,711,833 respectively. In U.S. Pat. No. 4,711,833, powder to be deposited electrostatically is charged tribo-electrically by frictional contact with a high speed fan. In U.S. Pat. No. 4,711,833 the more conventional electrostatic spray head is described in which powdered material is sprayed under pressure from a spray head that is electrostatically charged (in the order of 40,000 to 50,000 static D.C. volts).

The thickness of the deposited coating is generally a function of powdered particle size such as described in U.S. Pat. No. 4,711,833 where electrostatically charged powder particles having a diameter of about 30 to 40 microns provide a coating of about the same thickness for each pass. Prolonged exposure and a multiple passes enable the thickness to be increased to the level desired.

The electrostatically deposited layer of fluorocarbon material is apt to porous and is thus preferably sintered to melt or fuse it into a non-porous homogeneous solid construction. Such is preferably done after at least one layer of fiberglass strand or filaments has been wound under tension about the electrostatically deposited layer which is accomplished by passing the electrostatically coated fiberglass layer 6 through serving machine 22 which then spirally wraps fiberglass filaments or strands to provide layer 8 which, in the case of making insulated conductor 100, is then passed through a braiding machine referenced by numeral 24 which braids layer 10 of fiberglass filaments or strands about layer 8.

As earlier described, a protective high service temperature coating 12 is preferably applied to outer braided layer 10 (or to layer 8) where layer 10 has been omitted. Coating 12 may, for example be electrostatically deposited, extruded, or applied as an emulsion such as by passing layer 10 through a tank 26 containing an emulsified fluorocarbon material.

The insulated conductor preferably having outer coating layer 12 is then passed through an oven referenced by numeral 28 in which layers 6 and 12 (if present) are sintered at a suitable sintering temperature such as at a temperature of about 650° F. where the fluorocarbon material is PTFE which will fuse layer 6 as well as drive volatiles from layer 12 in cases where layer 12 has been coated on layer 10 as an emulsion.

Oven 28 need not be restricted to the location shown in FIG. 2 and may, for example be located between electrostatic deposition region 20 and serving machines 22 or between serving machines 22 and 24 where there is no coating 12 or at both locations where there is and layer 12 contains volitiles that ought to be driven off by heat.

What is claimed:

1. An insulated electrical conductor comprising an electrical conductor encompassed by at least one layer of fiberglass, an electrostatically deposited layer of fluorocarbon material disposed about the fiberglass layer, and at least one outer layer of fiberglass disposed about the layer of fluorocarbon material.

2. The insulated conductor of claim 1 wherein the fluorocarbon material is a sintered fluorocarbon material.

3. The insulated conductor of claim 1 wherein the fluorocarbon material is polytetrafluoroethylene.

4. The insulated conductor of claim 1 further including a protective coating about the outer layer of fiberglass.

5. The insulated conductor of claim 4 wherein the coating is a coating of fluorocarbon material.

6. The insulated conductor of claim 5 wherein the fluorocarbon material is a sintered fluorocarbon material.

7. The insulated conductor of claim 5 wherein the fluorocarbon material is polytetrafluoroethylene.

8. An insulated electrical conductor comprising an electrical conductor, a layer of fiberglass disposed contiguously about the conductor, an electrostatically deposited layer of fluorocarbon material disposed contiguously about the fiberglass layer and an outer layer of fiberglass disposed contiguously about the layer of fluorocarbon material.

9. The insulated conductor of claim 8 further including a braided fiberglass layer disposed contiguously about the outer fiberglass layer.

10. The insulated conductor of claim 8 further including a protective coating disposed about the braided fiberglass layer.

11. The insulated conductor of claim 10 wherein the coating is a coating of fluorocarbon material.

12. The insulated conductor of claim 11 wherein the fluorocarbon material is a sintered fluorocarbon material.

13. A method for making an insulated electrical conductor comprising:

providing an electrical conductor of indeterminate length;

disposing a layer of fiberglass about the conductor;

electrostatically depositing a layer of fluorocarbon material about the fiberglass layer;

disposing an outer layer of fiberglass about the fluorocarbon layer; and sintering the fluorocarbon material.

14. The method of claim 13 including the step of coating the outer fiberglass layer with a protective material.

15. The method of claim 14 wherein the protective material is a fluorocarbon material.

16. The method of claim 15 including the step of sintering the fluorocarbon material.

17. A method of making an insulated electrical conductor comprising:

providing an electrical conductor of indeterminate length;

spiraling a layer of fiberglass filaments contiguously about the conductor; electrostatically depositing a contiguous layer of fluorocarbon material about the fiberglass layer;

spiraling an outer layer of fiberglass filaments contiguously about the layer of fluorocarbon material;

disposing a braided layer of fiberglass about the outer fiberglass layer; and sintering the fluorocarbon material.

18. The method of claim 17 including the step of coating the braided fiberglass layer with a protective material.

19. The method of claim 18 wherein the protective material is a fluorocarbon material.

20. The method of claim 19 including the step of sintering the fluorocarbon material.

* * * * *